US009120198B2

(12) United States Patent
Ostertag

(10) Patent No.: US 9,120,198 B2
(45) Date of Patent: Sep. 1, 2015

(54) ROLLING BODY GUIDE WITH A SEPARATELY EXCHANGEABLE ROLLING BODY AS WELL AS A RECEIVING SECTION AND A ROLLING TOOL WITH AN ASSOCIATED EXCHANGE METHOD

(75) Inventor: Alfred Ostertag, Celle (DE)

(73) Assignee: ECOROLL AG Werzeugtechnik, Celle (DE)

( * ) Notice: Subject to any disclaimer, the term of this patent is extended or adjusted under 35 U.S.C. 154(b) by 993 days.

(21) Appl. No.: 12/931,913

(22) Filed: Feb. 14, 2011

(65) Prior Publication Data

US 2011/0206304 A1 Aug. 25, 2011

(30) Foreign Application Priority Data

Feb. 19, 2010 (DE) ..... 10 2010 008 693

(51) Int. Cl.
*B24B 39/00* (2006.01)

(52) U.S. Cl.
CPC ..... *B24B 39/003* (2013.01)

(58) Field of Classification Search
CPC ..... B21D 39/10; B21D 39/14; B21D 39/20; B21C 37/20; B24B 39/003
USPC ..... 72/75, 113, 120, 122, 126, 370.01; 29/895.2, 895.1, 898.09; 384/548, 559, 384/560, 572, 577, 578, 621, 623
See application file for complete search history.

(56) References Cited

U.S. PATENT DOCUMENTS

| | | | | |
|---|---|---|---|---|
| 1,364,252 | A * | 1/1921 | Cook et al. | 384/559 |
| 2,026,802 | A * | 1/1936 | Scribner | 384/577 |
| 3,353,881 | A * | 11/1967 | Steinert | 384/577 |
| 5,651,438 | A * | 7/1997 | Papania | 192/45.014 |
| 2009/0304317 | A1 * | 12/2009 | Schroeder | 384/445 |
| 2010/0111460 | A1 * | 5/2010 | Albrecht et al. | 384/572 |

FOREIGN PATENT DOCUMENTS

DE 102007009811 A1 * 9/2008

* cited by examiner

*Primary Examiner* — Teresa M Ekiert
(74) *Attorney, Agent, or Firm* — Collard & Roe, P.C.

(57) ABSTRACT

More specifically during manufacture of hydraulic cylinders for the crane industry, tubular bodies must be rolled on their inner and/or outer surfaces, in order to be able to ensure a sufficient durability of the hydraulic cylinders. Tools with a rolling body guide are used for this. The disadvantage of the prior art is that the replacement of a rolling body guide leads to immobilization times. The present invention therefore proposes an improvement to the prior art with a rolling body guide for receiving and feeding rolling bodies which are used for finish rolling or roller compression of an inner or outer surface of a tubular body and where the rolling body guide has at least two defined detachable receiving sections, so that a modular assembly of the rolling body guide is realizable.

12 Claims, 2 Drawing Sheets

Figure 1:
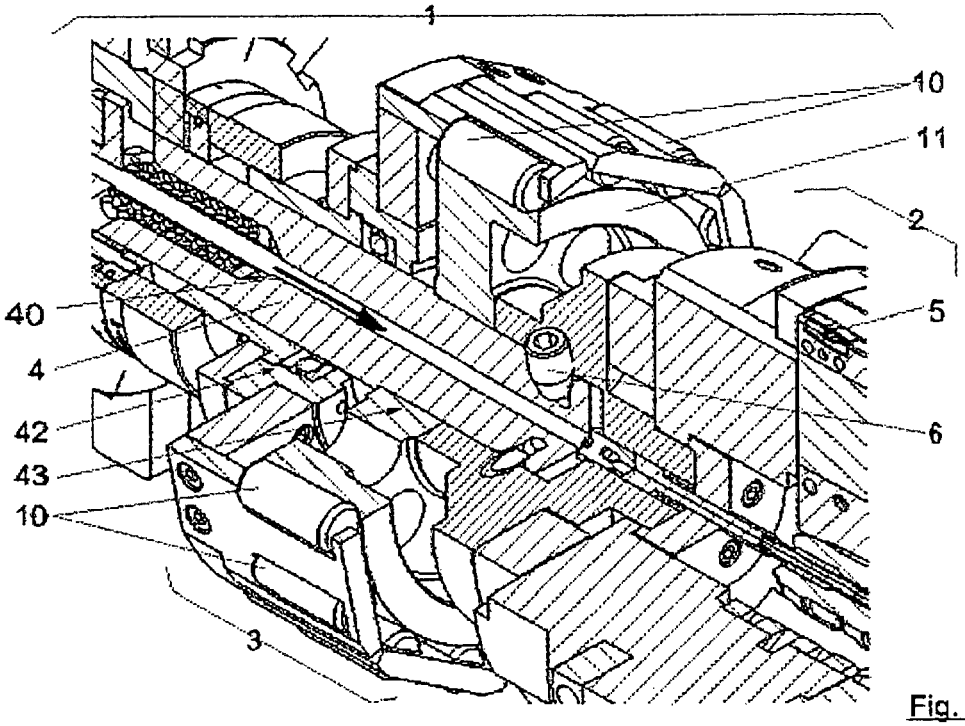

ROLLING BODY GUIDE WITH A SEPARATELY EXCHANGEABLE ROLLING BODY AS WELL AS A RECEIVING SECTION AND A ROLLING TOOL WITH AN ASSOCIATED EXCHANGE METHOD

CROSS REFERENCE TO RELATED APPLICATIONS

Applicant claims priority under 35 U.S.C. §119 of German Application No. 10 2010 008 693.2 filed on Feb. 19, 2010, the disclosure of which is incorporated by reference.

The invention concerns a rolling body guide as well as a receiving section and a rolling tool as well as an exchange method.

In order to prolong the durability of stressed metallic bodies, the surfaces of these bodies are worked by means of finish rolling bodies or roller compression bodies.

Tubular bodies, like those used for instance as brake cylinders in crane construction, are rolled on their inner or outer surface for this reason. Other axially symmetrical surfaces, for instance shafts, are also rolled.

The rolling tools employed thereby have rolling body guides. These rolling body guides are ring-formed and have rectangular or slightly trapezoid recesses. A rolling body which serves to work the surface to be rolled is attached in these recesses.

Since the recesses have narrower dimensions than the rolling bodies, the rolling bodies are prevented from falling out of the rolling body guide. The rolling bodies are thus positioned axially and tangentially by the rolling body guide.

The rolling bodies are preferably held in an axially parallel orientation or held at a certain angle relative to the axial parallelism.

In order to allow the surface to be worked by the rolling bodies, the rolling bodies are pushed against the surface of the tool to be worked by means of a supporting cone. During finish rolling or roller compression of the inner surface of a bore, the supporting cone thereby lies inside the rolling body guide, whereby the rolling bodies are pressed outward against the surface of the bore by the supporting cones.

A reverse arrangement, in which the supporting cones are pressed inward, thus allowing the rolls to work the outer surface, is used for rolling outer surfaces.

The rolling body guides are fastened on bearings. These bearings are supported for rotation relative to the tool shaft and can thus rotate. This can happen with the same rotational speed as the tool shaft as well as with a different rotational speed. A diameter of a circumscribed circle of the set of rolling bodies is defined by the ratio between the axial position of the rolling bodies and the supporting cone. This diameter is adjustable whereby the rolling process can be optimized.

In order to accomplish the adjustment of the diameter, the rolling body guide is displaced axially relative to the supporting cone by means of an adapted adjusting device.

In order to be able to carry out several working steps simultaneously, a machining element, for instance a peeling head, is frequently connected upstream of a rolling tool. This peeling head pre-machines the work piece during a rotational and feeding motion of the entire tool, whereupon a rolling of the inner or outer surface can be carried out in one clamping setting.

This type of rolling tools usually has a circumscribed circle diameter for inner surfaces between 38 and 400 mm. Even work pieces with a diameter exceeding 750 mm can be worked. These are the usual dimensions of hydraulic cylinders, for instance. The length of these hydraulic cylinders can often be 15 m. Such hydraulic cylinders are employed for instance in mobile cranes.

Rolling body guides, rolling bodies and supporting cones are subject to considerable wear and must be replaced when damaged. A rolling body guide must usually be exchanged after working a length of approximately 2000 m, since the required tolerances can otherwise not be observed anymore.

If a rolling body guide is to be exchanged, the rolling tool and the peeling head must first of all be removed, the peeling head being pulled off the shaft first. The rolling body guide is then pulled off the shaft in its entirety. The rolling bodies are subsequently removed from the recesses and the rolling body guide is replaced. The rolls are inserted again into a new rolling body guide and the rolling body guide is attached to the shaft and the peeling head is ultimately also attached to the shaft. The actual working process is subsequently continued.

The rolling bodies must be exchanged far more often. The exchange occurs in principle as described before, whereby the rolling bodies are exchanged instead of the rolling body guides. The rolling body guide with the new rolling bodies and the peeling head are mounted again and the working process is subsequently resumed.

The supporting cones can also be subject to wear. In the prior art, it is however not possible to inspect these supporting cones during operation or in the assembled state. Should an inspection of these supporting cones be indicated, the rolling body guide must also be removed as described before and the supporting cone must be uncovered. Other methods for inspecting the supporting cones are not possible because of the available space, the rolling bodies being spaced closely together, so that inspection windows for instance cannot be installed.

The previously described dismantling of the peeling head, of the rolling body guide and removal of the rolling bodies as well as the subsequent re-assembly and mounting takes as a rule between twenty minutes and half an hour. In the prior art, these expensive immobilization times are put up with.

Rolling body guides are generally manufactured from solid material. Because of the likewise tubular design, a material loss of approximately 90% of the original solid work piece occurs during machining.

Because of the complex production processes, rolling body guides are extremely expensive tools. It is moreover necessary to have many rolling body guides of different diameters in stock, since different rolling body guides must be kept at hand because of the diameters of the rolling body guides specified for different work piece diameters. Because of this diversity of pieces, the rolling body guides are manufactured in small numbers, thus making production even more expensive.

The object underlying the invention is to improve the prior art.

The object is solved by a rolling body guide for receiving and displacing rolling bodies which are used for finish rolling or roller compression of an inner or outer surface of a tubular body, the rolling body guide having at least two defined detachable receiving sections, so that a modular assembly of the rolling body guide is realizable.

The following notions must be explained:

A "receiving section" is a receptacle with a guide for rolling bodies with a cylindrical mantle that does not completely surround them. The receptacle is divided instead into sections, which delineate a surrounding angle of at most 180° relative to the central rotational axis, the rolling bodies thus being guidable.

A rolling body guide broken up in such sections embodies an aspect of the invention according to which the rolling body guide can be removable laterally from the rolling tool. This type of rolling body guide advantageously makes it possible to implement different roll diameters with only one type of rolling body guide.

In the case where two half-cylindrical receiving sections are connected on one hem and may be opened on another hem, the invention is already embodied since such a rolling body guide is laterally removable from the tool.

Pulling off the peeling head when substituting the rolling body guide or the rolling bodies can be thus omitted.

In another embodiment, the receiving sections can be respectively attached in a defined detachable manner on a receiving section carrier. In order to manufacture the receiving section carrier at a particularly low price or to simply fasten the rolling blade tool onto the shaft, the receiving section carrier can have a disc ring-shaped or disc-shaped body.

The receiving section carrier can additionally have a bearing receptacle for receiving the receiving section. The receiving sections can is thus particularly accessible and can be quickly mounted or dismounted, since the bearing receptacle for receiving the receiving sections lies on the circumference of the receiving section carrier.

In another embodiment, the receiving sections can be taken off perpendicularly and/or axially relative to a rotational axis. In such a design the assembly work when taking off or attaching the rolling body guide does not depend on the work space which would only be moderately available in case of a peeling head connected upstream. A combined removal of a receiving section, which occurs perpendicularly and/or axially, consists of tilting or pulling off the receiving section backward or forward parallel to the rotational axis.

In order to reliably guide the rolling bodies with respect to the circumference during the feeding motion of the rolling tool, the rolling body guide can have a torque-proof and/or shift-proof bearing of the receiving sections on the receiving section carrier.

It is thereby advantageous that the requirements regarding the torque resistance of the bearing can be low, since the rolling bodies behave analogously to the roller bearing rolls or the roller bearing needles during the rolling motion between the supporting cone and the tool surface to be worked. Hence it follows that only slight tangential forces occur, which make a low-cost sectional assembly of the rolling body guide possible. Since low forces occur on the bearing, the receiving sections can be fastened via a clamping mechanism and/or a dovetailed profile, whereby a screw-free fastening is implemented.

In another embodiment, the receiving sections are spaced with respect to a receptacle circumference.

The following notions must be explained.

A "receptacle circumference" is more specifically an envelope around the rolling body guide lying in the area of the rolling body receptacles. Breaches can thus occur in the rolling body guide, thus making a visual inspection of a supporting cone possible. It must be most particularly emphasized that the use of some of the material can be thus dispensed with, whereby the rolling body guide can be manufactured at a lower cost as well as with a lower weight.

In order to implement sections in the smallest possible manner, a receiving section can preferably have one or two, if necessary three or more guides for the rolling body or bodies. The smaller the number of receiving sections, the bigger the possible number of breaches that can be formed between the receiving sections, which increases the possible economization of material.

In a respective embodiment, the receiving sections can furthermore have a narrow design. With the same number of receiving sections, they can moreover be disposed at different intervals relative to each other, thus providing an extensive spectrum of roll diameters to be implemented.

It is also possible to use identical receiving sections in different numbers, whereby a great quantity can be manufactured, thus making it possible to increase the lot size and along with this to decrease the costs. In this case, different receiving section carriers that are adjusted to the respective overall diameter can for instance made available. It is thereby advantageous that the wear of the receiving section carriers is low.

The proposed solution makes it possible to assemble and therefore provide tube diameters between 80 mm and 400 mm.

In another implementation, the receiving sections are shaped flat and are equipped with two, three or more receptacles, the receptacles being reduced toward an upper side of the receiving section and shaped for a receiving body, so that a finish rolling or roller compression of a tubular body can be ensured.

At this point it must be pointed out that a rolling body guide with spaced receiving sections is in itself an advantageous and inventive design.

In order to implement big lot sizes for the manufacture of receiving sections, all receiving sections can be configured in the same manner and be more specifically disposed symmetrically around the circumference of the receptacle. The assembly is thus also simpler, since a great variety of products is ensured and a mixing up is excluded. This applies analogously to the symmetrical disposition of the receiving sections around a circumference of the rolling body guide.

In another embodiment, a bearing roll or a bearing ball can be fastened on a feed front of a rolling body receptacle. During the feed motion of the rolling body guide, this bearing roll or bearing ball drives the rolling body disposed in the rolling body guide along the rolling axis of the rolling body. The necessary force for the feed motion is transferred onto the front surface of the cylindrical body via a narrow front of the recess. If a bearing roll or a bearing ball misses, the roller cage will wear more specifically on this front of the section.

However, since a bearing roll or a bearing ball is provided, the feed force does not impact directly on the rolling body guide, whereby the durability of rolling body guide can be increased.

It is proposed to dispose the receiving section guiding the rolling body geometrically with respect to different diameters. It must thereby be ensured that a circular circumference around the disposed receiving sections and the rolling bodies received therein is disposed in such a manner that the circumference circle is touched merely by the rolling bodies. From this it follows that it must be excluded that the material actually making up the receiving sections or the rolling body guide is tangent to or cuts the circumference circle.

This can be ensured by a bent or curved sheet metal shape forming the receiving section, edges of the upper side being trimmed.

Flat metal sheets can however also be employed. This is more specifically possible, when the receiving sections have a lowest possible projection laterally to the recesses for the rolling bodies. It is therefore proposed that this projection amounts at most to twelve, more specifically less than ten millimeters. An edge trimming can here also occur on the upper side, whereby the lateral projection can be increased.

In another embodiment, the receiving section can be implemented by a continuous bore with a countersink, so that the receiving section can be fastened by means of a countersunk screw onto the receiving section carrier. By using a countersunk fixation it is excluded that the receiving section is tangent to or cuts the circumference.

One aspect of the present invention is that tool parts or tool elements can be removed from the rolling tool in such a manner that a disassembling of the tool elements for instance can be omitted. This aspect can also be extended to the supporting cone.

A rolling tool with rolling bodies for working the inner or outer surface of a tubular body and with a rolling body guide for displacing the rolling bodies and with a supporting cone for adapting the rolling body against the inner or outer surface can be thus made available, the supporting cone having two defined detachable cone sections that are fastened to each other.

The following notions must thereby be explained:

A "cone section" is either directly connected to another cone section or attached together with this cone section to a common support in such a manner that a seamless connection occurs.

According to whether the rolling body guide and the receiving sections are mounted or dismounted, the supporting cone can here be taken off laterally, more specifically axially and/or perpendicular to a rotational axis of the rolling tool. A rapid and simple exchange is herewith also ensured and the dismounting of other elements such as a peeling head can be omitted.

In a respective embodiment, a circumference transition between two neighboring cone sections can have a coating, a beveling or a filled recess on two hems. The coating as well as the filling can hereby cushion the edges along the circumference on the level of the rolling bodies where the cone sections border on each other. A soft coating or a soft filling material can thereby be used. In the presence of a beveling, the roll can slightly fall into the inside of the receptacle, so that no great forces which could damage the components occur when the hems roll over each other.

In another aspect of the invention, the object can be solved by an exchange method for a defective rolling body guide and/or defective rolls of a tool for finish rolling or roller compression of an inner or outer surface of a tubular body, with a rolling body, a rolling body guide and a supporting cone, the rolling body guide being first opened and/or separated and being taken off the tool substantially perpendicularly and/or axially relative to the rotational axis and, after a replacement, the rolling body guide being also deposited substantially perpendicularly and/or axially relative to the rotational axis of the tool and is locked and/or connected back there.

An inspection of the surface of the supporting cone as well as a dismounting or an exchange can thus be made possible. The receiving sections can furthermore be configured substantially flat, whereby an important requirement for manufacturing in great numbers is fulfilled.

The receiving section carriers are borne in the usual manner on a tool shaft. The bearing can be equipped with an adjusting device, so that the receiving section carrier is adjustable in a defined manner in the axial direction. Such adjusting devices are known in the prior art and can be adopted accordingly.

Figure 2:
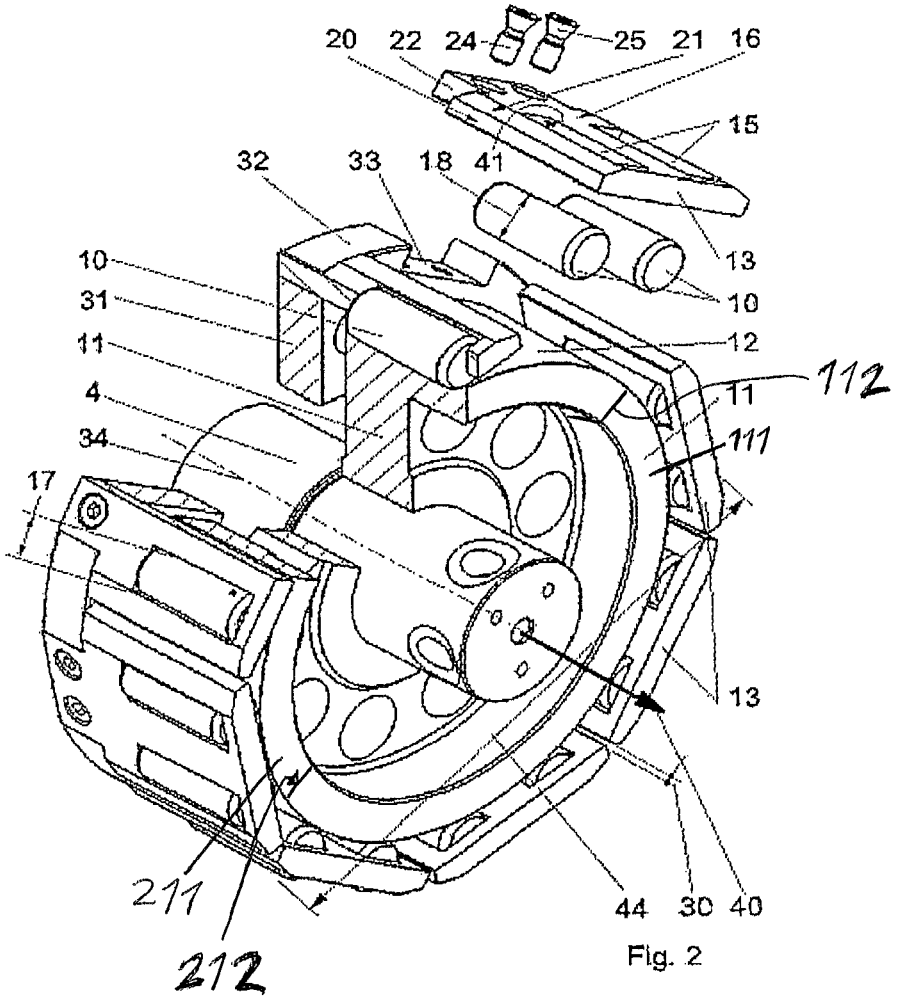

In the following, an exemplary embodiment is explained more closely by means of the figures. In the drawings:

FIG. 1: a schematic representation of a rolling tool with a peeling head and a finish rolling head in a partially sectioned three-dimensional view and FIG. 2: a schematic representation of the rolling tool in a partially sectioned three-dimensional view.

The numerals refer to FIGS. 1 and 2. A rolling tool 1 has a peeling head 2 and a downstream finish rolling head 3. The peeling head 2 as well as the finish rolling head 3 are fastened on a common shaft 4. The peeling head 2 carries peelers 5 that are disposed on the circumference for machining. The peeling head 2 additionally has a peeling head fastener 6 on the shaft 4. The rolling bodies 10 are assigned to the finish rolling head 3 and serve to finish roll the surface of a work piece.

The finish rolling head 3 additionally has a supporting cone 11 which is disposed on the shaft and is in contact with the rolling bodies 10 at a rolling surface 12. The rolling bodies 10 are held in position by a rolling body guide (not numbered in its entirety) divided into sections 13. The rolling bodies are located in receptacles 15 which are reduced toward an upper side 16 of the receiving section 13 to a clearance 17. The clearance 17 is thereby smaller than a diameter of the rolling bodies 10.

Two receptacles 15 for the rolling bodies 10 are assigned to each receiving segment 13. The receptacles 15 are substantially rectangular and are thereby approximately 110 mm long and 45 mm wide. In the area 20 of the edge, the rolling body guide is trimmed parallel to an axis 21 of a rolling body. The edges are not trimmed in a fastening area 22.

In order to mount the receiving section 13 to the receiving section carrier 31 two receptacles for screws 24 with countersunk heads 25 are provided in the fastening area. The receiving sections 13 spaced relative to each other by gaps 30 are detachably attached by means of these to a disc-shaped receiving section carrier 31. The receiving section carrier 31 is oriented along a circumference 32 on receiving bearings 33 plane-parallel to a rotational axis 34 of the tool 1 so that the plane areas of the receiving sections 13 can be fastened and fixed planar on the receiving bearing 33, whereby a parallel orientation relative to the axis 34 is already formed. In the present invention, all receiving sections are configured identically and are placed uniformly around the circumference 32 of the receiving section carrier 31. The receiving bearing 33 is torque-proof and/or shift-proof.

The receiving section carrier 31 is supported for rotation relative to the shaft 4 by means of the bearing 42. The supporting cone 11 has a hub 43 close to the center. This is secured against rotation relative to the shaft 4. During operation, the supporting cone rotates with the shaft 4. The receptacle with the rolling bodies 10 rotates at a low rotational speed which is defined by the rolling motion of the rolling bodies 10 between the supporting cone and the inner wall of the tube not represented in the picture. The supporting cone 11 has two defined detachable cone sections 111 and 211 that are fastened to each other. A circumferential transition between two neighboring cone sections has a coating, a beveling or a filled recess on two hems 112 and 212.

The receiving sections 13 are thus independently detachable from the receiving section carrier 31, whereby selective replacements of defective receiving sections or rolling bodies occur. An inspection window for the supporting cone 11 is thus furthermore made available in a simple manner. The frictional contact between the receiving sections 13 and the rolling bodies 10 during a feed motion with a feed front 41 via a small steel ball (not represented) causes the receptacles 15 to be preserved to the greatest possible extent during a feed motion or a withdrawing of the tool 1 from the work piece along a motion direction 40.

The rolling body guide represented in the present invention has an outer diameter of approximately 150 mm. Because of the receiving section 13 and the consequential modular construction of the rolling body guide, the diameter only depends on the circumference diameter 32 of the segment carrier 31 and on the number of the receiving sections 13. Thus, in order to make a bigger or smaller rolling body guide available, the receiving section carrier 31 can be exchanged with a receiving section carrier having another diameter. The trimmed edges 21 of the receiving sections 13 can implement together with the represented receiving section a very small rolling body guide with respect to its diameter its dimensions being of approximately 100 mm.

With the system according to the invention any tool diameters 44 can be implemented while using the same receiving sections 13. With smaller diameter changes, the distance 30 is varied. With bigger diameter changes, the number of receiving sections 13 and of rolling bodies 10 is varied. It is hereby important as a rule to assign the greatest possible number of receiving sections to the tool.

The invention claimed is:

1. A rolling tool configured to roll an inner or an outer surface of a manufactured tubular body, having a longitudinal axis, and configured to move axially along the longitudinal axis to be removed or displaced from the manufactured tubular body, the rolling tool comprising:

a plurality of rolling bodies for working an inner or outer surface of a tubular body, a rolling body guide for feeding the rolling bodies, and a supporting cone for pressing the rolling bodies against the inner or outer surface, wherein the supporting cone has two defined detachable cone sections fastened to each other and disposed adjacent to each other in a circumferential direction.

2. The rolling tool according to claim 1, wherein the first and second defined detachable receiving sections are removable from the receiving section carrier perpendicularly and/or axially relative to a rotational axis.

3. The rolling tool according to claim 1, wherein the receiving section carrier has a torque-proof and/or shift-proof bearing receiving the first defined detachable receiving section, and wherein the receiving section carrier has a torque-proof and/or shift-proof bearing receiving the second defined detachable receiving section.

4. The rolling tool according to claim 1, wherein the receiving section carrier has a disc ring-shaped or ring-shaped body.

5. The rolling tool according to claim 1, wherein the receiving section carrier has a bearing receptacle for receiving the first defined detachable receiving section, and wherein the receiving section carrier has a bearing receptacle for receiving the second defined detachable receiving section.

6. The rolling tool according to claim 1, wherein the first defined detachable receiving section is spaced from the second defined detachable receiving section around a circumference of the receiving section carrier.

7. The rolling tool according to claim 1, wherein the first defined detachable receiving section has at least one receptacle for a respective rolling body of the rolling bodies, and wherein the second defined detachable receiving section has at least one receptacle for a respective rolling body of the rolling bodies.

8. The rolling tool according to claim 1, wherein the first defined detachable receiving section is configured identically to the second defined detachable receiving section, and wherein the first defined detachable receiving section and the second defined detachable receiving section are disposed symmetrically around a circumference of the receiving section carrier.

9. The rolling tool according to claim 1, further comprising a bearing roll or a bearing ball on a feed front of a rolling body receptacle of the rolling body guide.

10. The rolling tool according to claim 1, wherein the receiving section is a flat, bent or curved metal sheet having the upper side and the at least one receptacle, and wherein edges of the upper side are trimmed.

11. The rolling tool according to claim 1, wherein the two defined detachable cone sections are a first cone section and a second cone section neighboring the first cone section, wherein a first hem divides the first cone section and the second cone section, wherein a second hem divides the first cone section and the second cone section, and wherein a circumferential transition between the first and second cone sections has a coating, a beveling or a filled recess on the first and second hems.

12. An exchange method for a defective rolling body guide and/or defective rolls of a tool for finish rolling or roller compression of an inner or outer surface of a tubular body, the tool comprising a rolling body, a rolling body guide, a receiving section carrier disposed axially in front of or behind the rolling body guide, and a supporting cone, the method comprising steps of:

opening and/or separating the rolling body guide, subsequently substantially taking off the rolling body guide from the receiving section carrier perpendicularly and/or axially relative to a rotational axis of the tool and perpendicularly and/or axially relative to the receiving section carrier, and depositing a replacement rolling body guide on the receiving section carrier substantially perpendicularly and/or axially relative to the rotational axis of the tool and perpendicularly and/or axially relative to the receiving section carrier, and locking and/or attaching the replacement body guide on the receiving section carrier.

* * * * *